United States Patent [19]

Bewley et al.

[11] 4,033,467

[45] July 5, 1977

[54] DUAL CYLINDER ROTATING SOLIDS FEEDER AND METHOD

[75] Inventors: William L. Bewley, Fullerton; Herbert F. Wilkinson, deceased, late of Anaheim, Calif., by Alice E. Wilkinson, executrix

[73] Assignee: Union Oil Company of California, Brea, Calif.

[22] Filed: June 1, 1976

[21] Appl. No.: 691,634

[52] U.S. Cl. ..... 214/23; 202/262; 214/152; 222/217

[51] Int. Cl.[2] ..... C10B 31/02

[58] Field of Search ..... 214/17 B, 17 C, 18 R, 214/18 V, 23, 152; 222/217; 202/262

[56] References Cited

UNITED STATES PATENTS

| | | | |
|---|---|---|---|
| 2,501,153 | 3/1950 | Berg | 214/23 X |
| 3,782,272 | 1/1974 | Cooper | 222/217 X |

*Primary Examiner*—Robert G. Sheridan
*Attorney, Agent, or Firm*—Richard C. Hartman; Dean Sandford

[57] ABSTRACT

A solids feeder for transporting particulated solids from a solids feed supply into the bottom of a solids upflow vessel. The feeder includes a solids feed chute terminating in a bottom outlet spaced apart from and in essentially the same horizontal plane as the bottom solids inlet of the solids upflow vessel. A pair of solids feed cylinders provided with free-floating pistons are vertically mounted on a rotatable carriage positioned below the solids upflow vessel. The carriage is rotated between two stationary positions in which the cylinders are alternately aligned with the bottom solids inlet of the solids upflow vessel and the bottom outlet of the solids feed chute. Stationary hydraulic rams are positioned below both of these stationary positions to effect displacement of the pistons within the cylinders.

15 Claims, 5 Drawing Figures

DUAL CYLINDER ROTATING SOLIDS FEEDER AND METHOD

BACKGROUND OF THE INVENTION

1. Field of the Invention

This invention relates to solids handling, and more particularly to methods and apparatus for introducing particulated solids into the bottom of a solids upflow vessel such as a vertical solids upflow retort vessel used for heat treating oil-producing or oil-containing solids to recover oil and/or gas therefrom.

2. Description of the Prior Art

The problem of transporting particulated solids from a solids feed supply such as a bin or reservoir of the particulated solids into the bottom of a solids upflow vessel has been encountered in diverse operations, exemplary of which are the feeding of oil-producing and/or gas-producing solids such as oil shale, tar sand, bituminous coal, oil-saturated diatomaceous earth, and the like into the bottom of a vertical solids upflow retort for treating the solids to recover oil and/or gas therefrom, and the production of synthesis gas by the reaction of gas containing steam with carbonaceous solids such as coal, coke, and the like.

In these operations, difficulties are encountered in the design and operation of mechanical feed systems because of the nature of the particulated solids being transported, typical solids being abrasive and difficult to handle on the one hand, and on the other being friable and tending to abrade, thereby forming large quantities of undesirable fine particles. Feeder devices used to introduce solids into the bottom of an upflow solids bed must move the solids against the weight of the solids bed. Also, it is often the case that the solids must be transported from a storage bin at atmospheric pressure into a solids upflow vessel which operates at a superatmospheric pressure. These factors, coupled with the often gigantic size of the equipment required to obtain the desired solids feed capacity, and the fact that in some applications the feeder device must operate at elevated temperatures and in contact with liquids and/or gases produced in the solids treating process, produce difficult design problems involving large and complex mechanical forces and complicated mechanical loadings that must be adequately provided for in the feeder design.

A number of different solids feeders for introducing solids into the bottom of a vertical solids upflow vessel have been proposed in the patent literature. Typical of these are U.S. Pat. No. 2,501,153 to Berg which discloses a solids upflow oil shale retort in which the particulated oil shale is introduced into the bottom of the vertical retort by means of a piston reciprocating in a cylinder that is oscillated between the shale feed hopper and the retort inlet. The cylinder is moved into an inclined or canted position below the shale feed hopper and the piston retracted to permit the particulated oil shale to flow by gravity into the cylinder. The cylinder is then oscillated into a vertical position below the retort and the piston moved upwardly to charge the oil shale into the bottom of the retort forcing the entire bed of solids in the retort upward, retorted oil shale being withdrawn from the top of the bed. The feed cylinder is oscillated between the shale feed hopper and the retort inlet by means of a gear and pin drive assembly. U.S. Pat. No. 2,640,014 to Berg discloses a hydraulically oscillating cylinder bottom feeder in which the feeder piston is driven by a hydraulic power cylinder. The feeder is pivotally mounted on a trunion and oscillated between the feed hopper and the bottom inlet of the retort by means of a second hydraulic power cylinder acting laterally upon the bottom of the feed cylinder. U.S. Pat. No. 2,875,137 to Lieffers et al. discloses another embodiment of such device in which the feed cylinder is pivotally mounted on a bottom trunion and oscillated between the shale feed hopper and the retort inlet by means of a second hydraulic power cylinder acting laterally on the top of the feed cylinder. This latter embodiment was successfully employed in a small 2,000 tons per day prototype oil shale retort.

While oscillating cylinder feeders of the type disclosed in the Berg and Lieffers et al. patents can be satisfactorily employed to introduce particulated solids into the bottom of a solids upflow vessel, a number of serious problems and limitations are encountered when utilizing feeders of this type in large capacity commerical units such as solids upflow oil shale retorts having capacities in the range of 10,000 tons per day, or more. Specifically, the oscillating cylinder feeders for these capacities are extremely large and require substantial clearance between the foundation and the bottom of the retort, increasing the height of the retort structure and adding substantial cost. The clearance between the arcuate shale guard and the bottom of the shale hopper and the retort must be extremely close, i.e., in the range of 0.005 inches or less. Machining of the parts to these close tolerances cannot be readily obtained, and at best is extremely costly. Also, the capacities of single cylinder feeders are limited, and high capacities require extremely large units operating at relatively high speeds. Furthermore, it is difficult to fill the feed cylinder when it is in the inclined or canted position, and the oscillating cylinder feeders have reduced volumetric efficiency. These factors all contribute to the complexity of the mechanical design, increase the cost, and reduce the operating efficiency of this type of solids feeder.

Various other solids feeder systems have been proposed, exemplary of which are those described in U.S. Pat. Nos. 300,385 to Matieu and 2,029,760 to Derby et al. German Pat. No. 144,436 discloses a manually operated device for stoking a boiler with coal which includes a piston-containing cylinder into which the coal is loaded and a lever mechanism for moving the cylinder horizontally into position below the fire box and driving the piston upwardly to force the coal into the bottom of the bed of burning coal. While such device may have application in firing small boilers, it is wholly unsuited for feeding particulated solids into the bottom of a large capacity solids upflow vessel, which may be operated at superatmosphere pressure.

Thus, need exists for a relatively inexpensive, reliable, high capacity, solids feeder for introducing particulated solids into the bottom of a solids upflow vessel, and particularly into the bottom of a vertical solids upflow retort vessel useful for heat treating oil-producing or oil-containing solids to recover oil and/or gas therefrom.

Accordingly, a principal object of this invention is to provide a solids feeder for introducing particulated solids into the bottom of a solids upflow vessel.

Another object of the invention is to provide a solids feeder for introducing particulated solids into the bottom of a solids upflow vessel at relatively high charge rates.

Still another object of the invention is to provide a solids feeder having a high volumetric efficiency.

A still further object of the invention is to provide a high capacity solids feeder for introducing particulated solids into the bottom of a solids upflow vessel in which close mechanical clearances, high bearing loadings, high mechanical stresses, and high speed movement of mechanical parts are minimized.

Yet another object of the invention is to provide a solids feeder for introducing particulated oil shale into the bottom of a solids upflow, fluid downflow retort operating at superatmospheric pressure.

Other objects and advantages of the invention will be apparent from the following description taken in conjunction with the appended drawings.

SUMMARY OF THE INVENTION

The solids feeder of this invention provides a means for transporting particulated solids from a solids feed supply into the bottom of a solids upflow vessel having a bottom solids inlet opening. The solids feeder includes a feed chute in communication with an elevated solids feed supply, the chute terminating in a bottom outlet spaced apart from and in essentially the same horizontal plane as the bottom solids inlet of the solids upflow vessel. A pair of solids feed cylinders provided with free-floating pistons are vertically mounted on a horizontally rotatable carriage positioned below the solids upflow vessel. The carriage is rotated between two stationary positions in which the cylinders are alternately aligned with the bottom solids inlet of the solids upflow vessel and the bottom outlet of the solids feed chute. Stationary hydraulic rams positioned below both of the stationary positions control the movement of the pistons within the cylinders.

The cylinders are provided with a bottom support ring to carry the free-floating piston at the bottom of the stroke, i.e., during that portion of the cycle that the cylinder is filled with solids. Hydraulically operated dogs are provided to support the piston at the top of the stroke during that portion of the cycle that the cylinder is empty.

In operation, the carriage is rotated to a first stationary position in which a first cylinder filled with solids is axially aligned with and immediately below the bottom solids inlet of the solids upflow vessel and a second empty cylinder with the piston at the top of the stroke is aligned with and immediately below the bottom outlet of the solids upflow vessel. A first hydraulic ram located below the bottom solids inlet of the solids upflow vessel is extended to drive the piston in an upward direction to displace the solids from the cylinder upwardly into the solids upflow vessel. The hydraulic dogs are then extended and the hydraulic ram retracted to seat the piston on the dogs. Simultaneously therewith, the second hydraulic ram located below the solids feed chute is extended to lift the free-floating piston in the second cylinder off of the supporting dogs, the supporting dogs retracted, and the hydraulic ram retracted to allow the piston to move downwardly in the cylinder and the cylinder to fill by gravity flow with solids from the solids feed chute. When the hydraulic rams are fully retracted, the carriage is rotated 180° to the second stationary position and the operating sequence repeated to charge solids into the solids upflow vessel and fill the empty cylinder with solids.

BRIEF DESCRIPTION OF THE DRAWINGS

The invention will be more readily understood by reference to the accompanying drawings, wherein like parts are identified by like numerals throughout, and in which.

DETAILED DESCRIPTION

Figure 1:
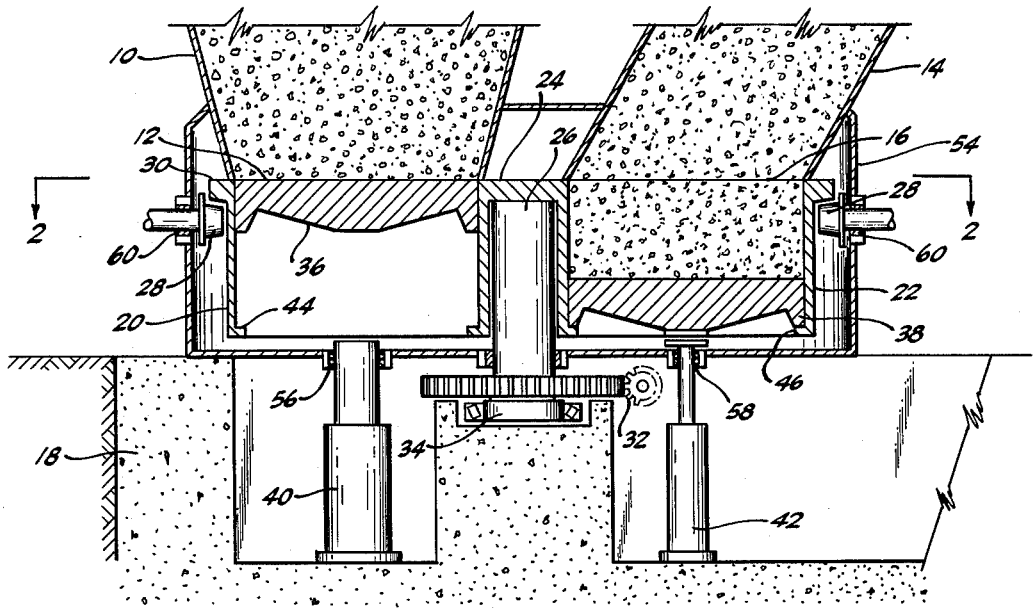
FIG. 1 is a vertical cross-sectional view illustrating the solids feeder of this invention.
Figure 2:
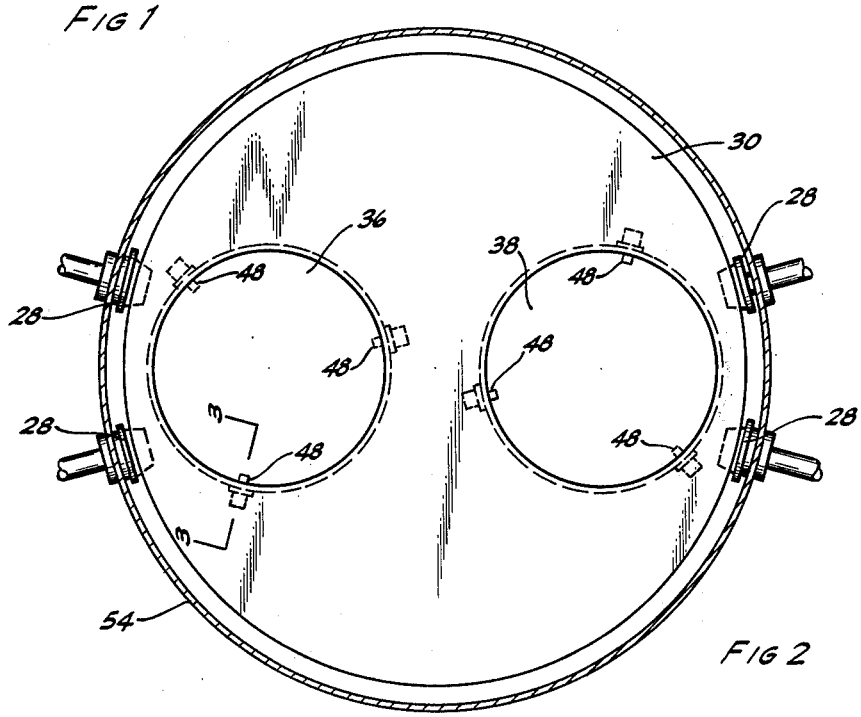
FIG. 2 is a horizontal cross-sectional view of the device taken along the line 2—2 of FIG. 1.

Referring now particularly to FIGS. 1 and 2, wherein there is shown the bottom section of an upflow solids vessel 10, such a solids upflow retort, having a bottom solids inlet 12. A feed chute 14 communicates with a particulated solids supply source, such as an elevated solids bin, not shown, and terminates in an open solids outlet 16 which is in essentially the same horizontal plane as solids inlet 12 and spaced apart therefrom in a manner which will be hereinafter more fully described. The solids upflow vessel and the solids feeder are supported on a suitable foundation 18, such as a conventional reinforced concrete foundation of adequate strength to support the structure.

A pair of solids feed cylinders 20 and 22 are vertically mounted in spaced relationship on rotatable carriage 24, which is adapted for rotation about vertical shaft 26. Carriage 24 is rotatably supported in a horizontal position immediately below solids upflow vessel 10 and solids feed chute 14 by means of a plurality of rollers 28 located around the periphery of the carriage 24, which rollers supportably engage external lip 30 extending around the periphery of carriage 24. Carriage 24 is fixedly mounted on vertical shaft 26 so as to rotate with the shaft, which in turn is rotatably driven by a suitable drive means, such as worm gear drive 32. Shaft 26 is also provided with suitable bearings 34 to carry the thrust load imparted to the shaft. Shaft 26 and the carriage can be rotatably driven through worm gear drive 32 by means of any suitable driver such as an electric motor, internal combustion engine or hydraulic motor capable of intermittent operation in which carriage 24 is periodically rotated 180° between first and second stationary positions, then held in the stationary position during the discharge and filing sequence.

Bottom solids inlet opening 12 of solids upflow vessel 10 and solids outlet 16 of solids feed chute 14 preferably are of the same diameters and are equally spaced from the central vertical axis of rotatable carriage 24 along a horizontal axis intersecting the axis of rotation of the carriage. Solids feed cylinders 20 and 22 are preferably of the same diameter as solids inlet opening 12 and solids outlet 16, and are mounted on carriage 24 so as to be spaced from the central axis of said rotatable carriage along a diameter thereof a distance equal to the spacing of solids inlet opening 12 and solids outlet 16. With this configuration, one of the solids feed cylinders will be axially aligned with and immediately below solids inlet opening 12 of solids upflow vessel 10 and the other solids feed cylinder will be axially aligned with and immediately below solids outlet 16 of feed chute 14 when the rotatable carriage is in a first stationary position, and the other solids feed cylinder will be axially aligned with and immediately below solids inlet opening 12 and the first cylinder will be axially aligned with and immediately below outlet 16 when the rotatable carriage is in a second stationary position after rotation of the carriage 180° about its axis of rotation from the first position.

Carriage 24 may be rotated in the same direction between the first and second stationary positions or, alternatively, the direction of rotation can be alternated with each cycle, e.g., the carriage can be rotated in a clockwise direction from the first stationary position to the second stationary postion, then in a counterclockwise direction from the second stationary position to the first stationary position.

Solids feed cylinder 20 is provided with free-floating piston 36 adapted for reciprocating movement in said cylinder, and solids feed cylinder 22 is provided with free-floating piston 38 adapted for reciprocating movement therein. Stationary hydraulic ram 40 is located below solids inlet opening 12 to operate the piston aligned therewith, and stationary hydraulic ram 42 is located below solids outlet 16 to operate the piston aligned with outlet 16. Solids feed cylinders 20 and 22 are provided with internal lips 44 and 46, respectively, extending around their lower peripheries to support pistons 36 and 38 at the bottom of their stroke.

Figure 3:
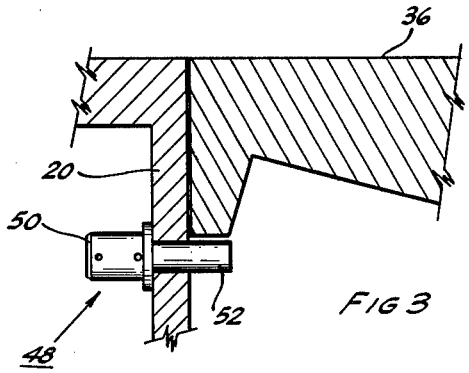
FIG. 3 is an enlarged cross-sectional view illustrating the hydraulically operated dogs for supporting the piston in an upper position.

The pistons 36 and 38 are supported at the top of the stroke by means of a plurality of hydraulically operated, extendable dogs 48 located around the periphery of cylinders 20 and 22. In the illustrated embodiment, three of such dogs 48 are spaced equally around the periphery of each of the solids feed cylinders. FIG. 3 is a detail illustrating the mounting of a typical dog 48 shown mounted in a typical solids feed cylinder, such as the cylinder 20. Hydraulically operated dog 48 consists of a hydraulic operator 50 that operates extendable member 52 which can be extended sufficiently to support the free-floating piston, such as the piston 36 in the case of solids feed cylinder 20 and piston 38 in the case of solids feed cylinder 22, and which can be retracted sufficiently to permit the piston to pass downwardly through the cylinder during the appropriate portion of the operating cycle.

The upper surface of rotatable carriage 24 is provided with a replaceable wear plate, not shown, covering the entire upper surface of the carriage except for the cylinder openings. The inlet of solids upflow vessel 10 and the outlet of chute 14 are provided with shear rings, not shown, fitted with lower removable wear rings, also not shown, which extend around the periphery of solids inlet opening 12 and bottom outlet 16. Chute 14 and solids upflow vessel 10 are arranged so that the bottom surface of the wear rings are in essentially the same horizontal plane and provide about ½ inch clearance between the bottom of the wear rings and the top surface of the carriage wear plate. The upper horizontal planar surface of rotatable carriage 24 serves as a stop gate to prevent flow of the particulated solids from chute 14 and from the bottom of solids upflow vesel 10 as the carriage is being rotated between the first and second stationary positions and the feed cylinders are not properly aligned with the chute and with the bottom inlet of vessel 10. The clearance between the bottom of the wear rings and the upper surface of the carriage wear plate can be varied, depending upon the size and type of the solids being handled, as required to provide a solids seal.

In the embodiment of the invention wherein the solids feeder is employed to introduce particulated solids into the bottom of a solids upflow, fluid downflow retort in which the liquid and gaseous constituents are withdrawn at the bottom of the retort, a housing 54 is provided to fluid tightly encase the bottom of vessel 10, the bottom of solids feed chute 14, and the carriage assembly. Liquid and gaseous fluids pass downwardly through vessel 10 in contact with the upflowing solids bed and pass outwardly through slots, not shown, in the lower section of vessel 10 immediately above bottom inlet 12, and into the chamber enclosed by housing 54. The liquid level is maintained in the housing by means of a liquid level controller, not shown, which operates a flow control valve in the liquid withdrawal line, not shown. Gas is withdrawn from the upper zone of housing 54 above the liquid interface by means of a gas drawoff conduit, not shown. In this manner, the gases and liquids exiting vessel 10 are separated and separately withdrawn from housing 54 for subsequent processing, and the entire rotatable carriage is operated submerged in oil, the oil level being maintained above the bottom of solids feed chute 14 to provide an oil seal. In this embodiment of the invention, hydraulic ram 40 is provided with fluid seal 56, hydraulic ram 42 is provided with seal 58, and rollers 28 are provided with seals 60 to maintain housing 54 fluid-tight.

In operation, carriage 26 is moved into a first stationary position as illustrated in FIG. 1, wherein feed cylinder 20 is located immediately below and axially aligned with bottom inlet 12 of solids upflow vessel 10 and feed cylinder 22 is located immediately below and axially aligned with outlet 16 of feed chute 14. While in this position, hydraulic ram 40 is extended to move piston 36 upwardly within cylinder 20 to discharge the solids content of the cylinder upwardly into vessel 10. When piston 36 reaches the top of its stroke, the dogs 48 in cylinder 20 are extended and the hydraulic ram 40 retracted to seat piston 36 on the supporting dogs. Simultaneously therewith, hydraulic ram 42 is extended to engage piston 38, which is in the upper position, and raise the piston off of the supporting dogs in cylinder 22. The hydraulically actuated dogs 48 are then retracted to permit the piston to pass downwardly through cylinder 22, the travel of which is controlled by retracting hydraulic ram 42. As piston 38 travels downwardly within cylinder 22, the cylinder fills by gravity flow with particulated solids from feed chute 14. Hydraulic rams 40 and 42 are retracted sufficiently to be clear of the respective pistons to permit rotation of carriage 24. When hydraulic rams 40 and 42 are fully retracted, and with piston 36 supported on dogs 48 and piston 38 supported on bottom lip 46, carriage 24 is rotated 180° to a position in which cylinder 20 is axially aligned below feed chute 14 and cylinder 22 is axially aligned below inlet opening 12 of solids upflow vessel 10. The aforedescribed operating sequence is repeated to displace particulated solids from cylinder 22 upwardly into vessel 10 and to fill cylinder 20 with solids from feed chute 14.

The above-described operating cycle can be summarized as follows:

| Sequence | Feed Cylinder 20 | Feed Cylinder 22 |
|---|---|---|
| First Stationary Position | Discharge | Fill |
| Rotate Carriage to Second Position | Idle | Idle |
| Second Stationary Position | Fill | Discharge |
| Rotate Carriage to First Position | Idle | Idle |

During each rotation sequence, solids downflow from vessel 10 and from feed chute 14 is substantially prevented by the upper planar surface of carriage 24, the upper surface of pistons 36 and 38 when in the upper position, or by the upper surface of the solids contained in a full feed cylinder.

Figure 4:
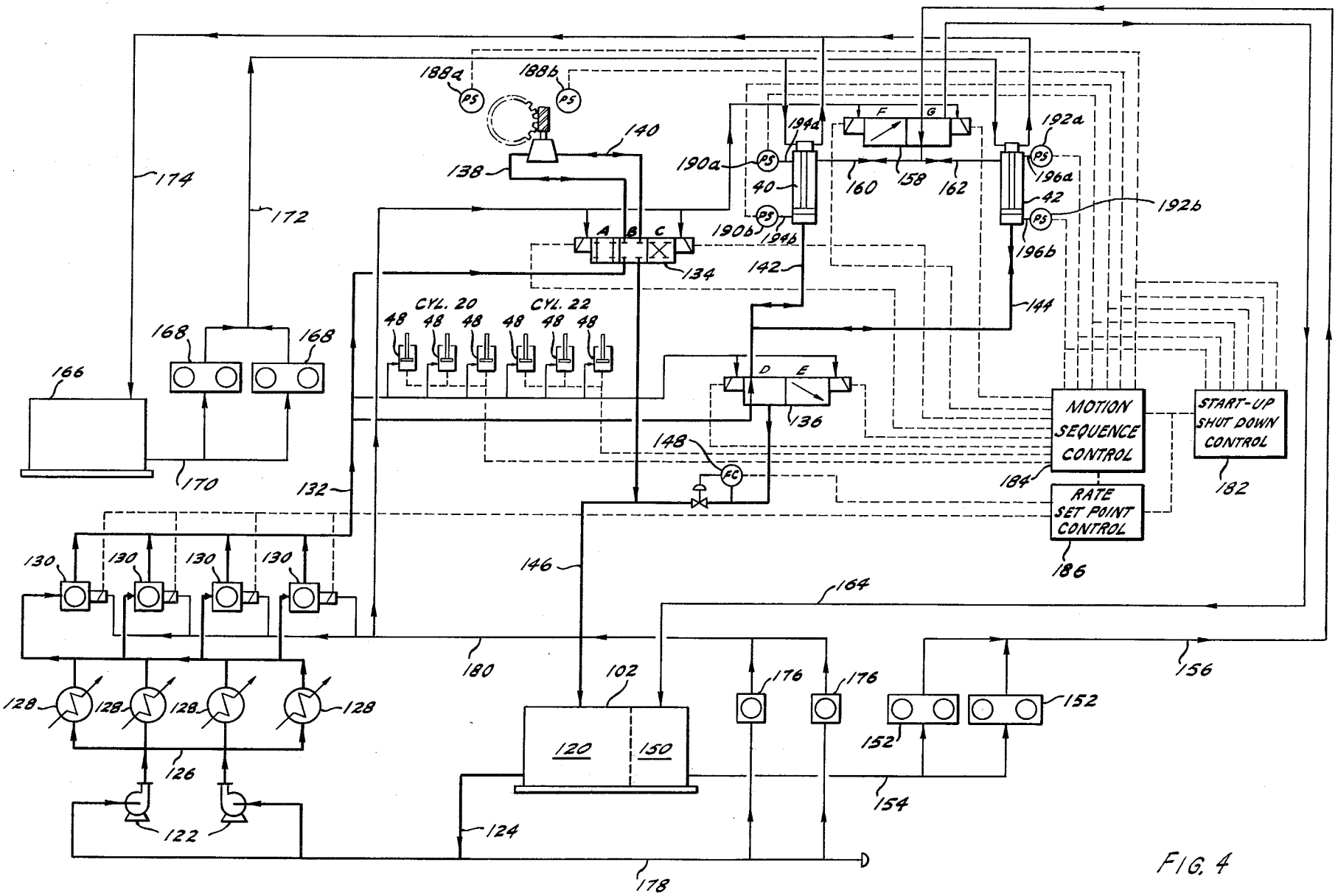
FIG. 4 is a schematic flow diagram illustrating the hydraulic system.

The hydraulic system used to operate the solids feeder includes four basic component systems: (1) a high pressure fluid power supply operating at a nominal presure of about 3,000 psig, (2) a low pressure fluid power supply operating at a nominal pressure of 30 psig, (3) a piston rod flushing system, and (4) a pilot pressure system. Referring now to FIG. 4, the high pressure fluid power system supplies the force for moving the solids up into and through solids upflow vessel 10 and the force for rotating carriage 24, and includes hydraulic fluid reservoir 102 having separate compartment 120 for the hydraulic fluid used in the high pressure system, two parallel-connected centrifugal booster pumps 122 connected to reservoir 102 by conduit 124, an discharge conduit 126 passing through four parallel-connected coolers 128 in which the hydraulic fluid is cooled by heat exchange against cooling water and supplying hydraulic fluid to the suction of four parallel-connected variable volume positive displacement pumps 130. Pumps 130 can be either radial piston positive displacement pumps or bent axis positive displacement pumps, with the latter being preferred. The high pressure discharge from pumps 130 passes through conduit 132 to multiported solenoid valves 134 and 136. Solenoid valve 134 is connected to the power fluid inlet and outler of hydraulic motor 104 by conduits 138 and 140, respectively. Hydraulic motor 104 can be of the reversible type, as illustrated, in which carriage 24 is rotated 180°, then rotated 180° in the opposite direction, or alternatively, hydraulic motor 104 can be of the non-reversible type wherein the carriage is rotated in the same direction during each sequence. Solenoid valve 136 is connected to the lower or high pressure sides of the power cylinders of hydraulic rams 40 and 42, respectively, by conduits 142 and 144. Solenoid valves 134 and 136 are also connected to high pressure hydraulic fluid return conduit 146 which returns the hydraulic fluid used in the high pressure system to reservoir 120, the return from solenoid valve 136 including flow controller 148.

The low pressure fluid power supply includes a separate compartment 150 in hydraulic fluid reservoir 102 for the hydraulic fluid used in the low pressure fluid power supply system, two parallel-connected gear pumps 152 connected to reservoir 150 by conduit 154, and a low pressure fluid supply conduit 156 connecting the pump discharge to multiported solenoid valve 158. Solenoid valve 158 is connected to the upper, or low pressure, side of the power cylinders of hydraulic rams 42 and 44, respectively, by conduits 160 and 162, and to reservoir 150 through pressure fluid return conduit 164.

The piston rod flushing system includes a separate flushing oil reservoir 166, two parallel-connected gear pumps 168 connected to reservoir 166 by conduit 170, and a flushing oil supply conduit 172 connecting the pump discharge to the packing glands of hydraulic rams 40 and 42. Flushing oil is returned to reservoir 166 from each of the packing glands through flushing oil return conduit 174. The flushing oil supplied to the packing glands of the various hydraulic rams minimizes rod and packing gland wear which might occur if solids adhering to the rod surfaces intruded into the packing glands.

The pilot pressure system furnishes hydraulic fluid for moving the directional control valves, for changing the displacement of high pressure hydraulic fluid supply pumps 130, and for power cylinder position sensing. The pilot pressure system includes two parallel connected pilot pressure fluid supply pumps 176 connected to a source of hydraulic fluid by conduit 178. Conduit 180 connected to the discharge of pumps 176 supplies pressurized pilot fluid to each of four rate control solenoid valves integral with each of the four high pressure hydraulic fluid supply pumps 130, i.e., a total of 16 solenoid valves, and to solenoid valves 134, 136 and 158.

The hydraulic fluid power supply systems are controlled by startup-shutdown controller 182, motion sequence controller 184 and rate controller 186. The position of rotatable carriage 24 is sensed by an integral hydraulic sensor, not shown, at each end of the 180° rotation of the carriage, i.e., in each stationary position, that hydraulically actuate pressure switches **188*a* and 188*b*, respectively. An instrument signal, such as an electrical signal is transmitted from each pressure switch to startup-shutdown controller 182 and motion sequence controller 184. The positions of the pistons in hydraulic power cylinders 40 and 42, respectively, are detected by integral hydraulic sensors, not shown, at each end of the stroke that hydraulically actuate pressure switches 190*a*, 190*b*, 192*a* and 192*b*, respectively, through conduits 194*a*, 194*b*, 196*a* and 196*b*. An instrument signal, such as an electrical output signal is transmitted from each pressure switch to startup-shutdown controller 182 and motion sequence controller 184. The pressure switches are preferably located on the exterior of housing 54. The output of startup-shutdown controller 182 is electrically connected to motion sequence controller 184 and to rate controller 186, and the output of motion sequence controller 184 is electrically connected to rate controller 186 and to each of the two solenoid units of solenoid valves 134, 136 and 158, and to each of hydraulically operated dogs 48. The output of rate controller 186 is electrically connected to the set point of flow controller 148 and to each of the four solenoid units integral with each high pressure hydraulic fluid pump 130**.

Figure 5:
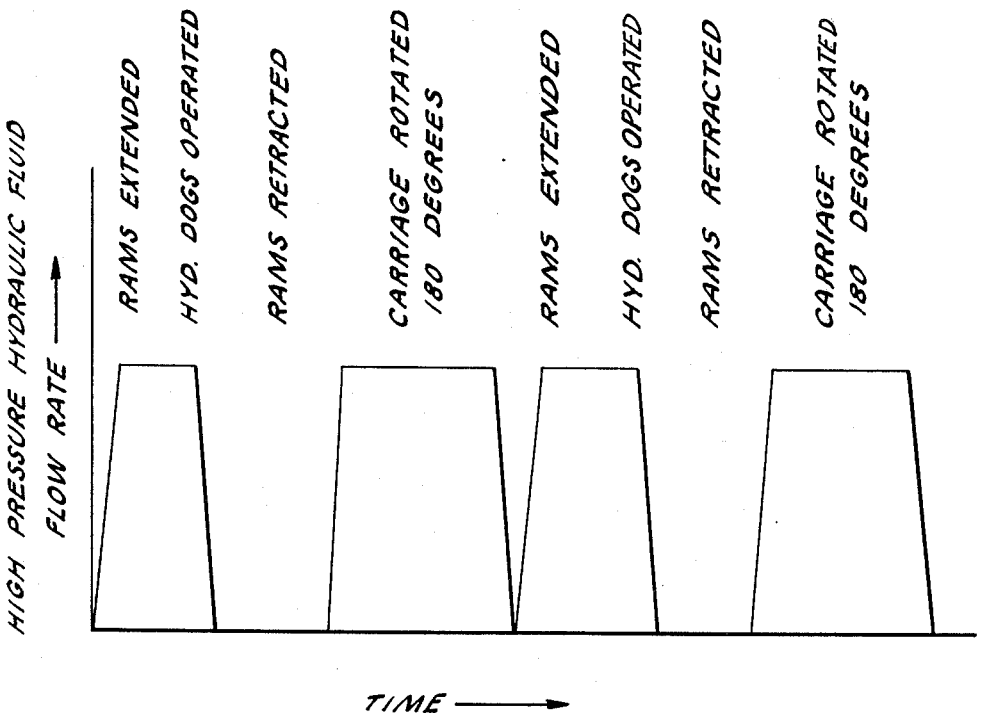
FIG. 5 is a graph illustrating the variation in the flow of hydraulic fluid during a typical cycle.

In operation, high pressure hydraulic fluid is supplied to either hydraulic motor 104 or hydraulic rams 40 or 42, with the fluid being switched between these users by solenoid valves 134 and 136. In this manner, high pressure hydraulic fluid is being supplied to one or the other inlets of hydraulic motor 104 to move carriage 24 in the appropriate direction or, alternatively, to hydraulic rams 40 and 42 to displace the solids content of the respective feed cylinder upwardly into solids upflow vessel 10 and to lift the empty cylinder off of its supporting dogs 48. Thus, the high pressure hydraulic fluid is utilized in either hydraulic motor 104 or hydraulic rams 40 and 42, the usage being switched between the various power units depending upon the sequence. Solenoid valves 134 and 136 also switch the high pressure hydraulic fluid return to conduit 146 during the appropriate portion of the sequence. The high pressure hydraulic fluid supply is preferably discontinuous with the solenoid valves 134 and 136 being switched during periods of essentially no flow. FIG. 5 shows the variation in the flow rate of the high pressure hydraulic fluid during a complete cycle, with the solenoid valves being switched during the periods of essentially no flow. Variable volume positive displcement pumps are particularly suited for this service since they can be rapidly switched from a neutral mode to a mode in which a predetermined volume of fluid is supplied, providing an acceleration and declaration period to reduce pressure shocks throughout the hydraulic system.

Low pressure hydraulic fluid is supplied to the upper, or inboard, ends of the power cylinders of hydraulic rams 40 and 42 during the downstroke portion of the cycle. This fluid is switched to the power cylinders of hydraulic rams 40 and 42 during the appropriate portion of the sequence by solenoid valve 158, which also switches the hydraulic fluid return from the low pressure end of the cylinder to low pressure hydraulic fluid return conduit 164 during the upstroke of hydraulic rams 40 and 42. Feed pistons 36 and 38 carry substantial weight during the filling sequence tending to force the pistons downward. Flow controller 148 limits the outflow of hydraulic fluid from the power cylinders of hydraulic rams 40 and 42 on the downstroke of the pistons to limit the speed of the piston during the cylinder filling sequence.

The speed of rotation of carriage 24 between the first and second stationary positions and the stroking speed of hydraulic rams 40 and 42 affect the volume of solids transported from feed chute 14 into the bottom of solids upflow vessel 10, i.e., the solids feed rate. These speeds are controlled by rate controller 186 which adjusts the set point of flow controller 148 and actuates the four solenoid valves in each of the pumps 130. In this manner, high pressure hydraulic fluid is supplied at one of sixteen preselected flow rates. Typical cycle times of a feeder for a solids upflow oil shale retort operated at feed rates of 10,000 and 15,000 tons per day are as follows:

| Step | Sequence | Time, min. 10,000 T/D | Time, min. 15,000 T/D |
|---|---|---|---|
| 1 | Stationary Position 1<br>Feed piston 28 on upstroke<br>Feed piston 30 on downstroke | 0.522 | 0.353 |

-continued

| Step | Sequence | Time, min. 10,000 T/D | Time, min. 15,000 T/D |
|---|---|---|---|
| 2 | Carriage rotating to Stationary Position 2 | 0.760 | 0.502 |
| 3 | Stationary Position 2<br>Feed piston 28 on downstroke<br>Feed piston 30 on upstroke | 0.522 | 0.353 |
| 4 | Carriage moving to Stationary Position 1 | 0.760 | 0.502 |
| | Total Cycle Time, min. | 2.564 | 1.710 |

The hydraulic system includes conventional filters, relief valves, isolation valves, and instrumentation, which items are not shown in the drawings.

Solenoid valve 134 is a multiported switching valve capable of simultaneously receiving fluids from two conduits and discharging fluids to two conduits, i.e., a total of four fluid conduit connections to the valve. The internal port mechanism is capable of axial movement into one of three operating positions in which two inlet conduits are connected to two outlet conduits, a closed position in which there is no fluid flow the valve, and a cross-connected position in which the inlet conduits are cross-connected to the opposite outlet conduits. These positions are identified, respectively, as position A, as position B, and position C, Solenoid valves 136 and 158 can be multiported switching valves of the type capable of receiving fluids from two sources and dispatching it to a single source, or vice versa, i.e., a total of three conduit connections to each valve. The internal port mechanism is capable of axial movement into one of two operating positions in which one inlet and outlet conduit are connected and a position in which another combination of conduits are connected. These positions are identified, respectively, as position D and position E in the case of solenoid valve 136; and position F, position G in the case of solenoid valve 158. The internal port mechanism is axially shifted in the valve body in a first direction by a hydraulic cylinder controlled by a solenoid driver mounted at one end of the valve, and in the opposite direction by a second hydraulic cylinder controlled by a solenoid driver mounted at the opposite end of the valve. The hydraulic cylinders are powered by hydraulic fluid supplied from the pilot pressure system. Thus, each solenoid valve can be selectively positioned in any one of the operating positions depending upon the operational mode desired for a particular sequence.

The operating sequence of multiported solenoid valves 134, 136 and 158 to control the motion of the various hydraulic pistons is illustrated in the following sequence schedule:

| Step | Sequence | Switching Valve 134 | Switching Valve 136 | Switching Valve 153 |
|---|---|---|---|---|
| Stationary Position 1 | | | | |
| 1 | Rams 40 and 42 extended | Position B (No flow) | Position D (Supply) | Position F (Return) |
| 2 | Dogs on cyl. 20 extended and dogs on cyl. 22 retracted | Position B (No flow) | Position D (Supply) | Position F (Return) |
| 3 | Rams 40 and 42 retracted | Position B (No flow) | Position E (Return) | Position G (Supply) |
| Rotate Carriage to Stationary Position 2 | | | | |
| 4 | Carriage rotation clockwise | Position A (Inboard supply, outboard return) | Position E (Return) | Position G (Supply) |
| Stationary Position 2 | | | | |
| 5 | Rams 40 and 42 extended | Position B (No flow) | Position D (Supply) | Position F (Return) |

-continued

| Step | Sequence | Switching Valve 134 | Switching Valve 136 | Switching Valve 153 |
|---|---|---|---|---|
| 6 | Dogs on cyl. 22 extended and dogs on cyl. 20 retracted | Position B (No flow) | Position D (Supply) | Position F (Return) |
| 7 | Rams 40 and 42 retracted | Position B (No flow) | Position E (Return) | Position G (Supply) |
| Rotate Carriage to Stationary Position 1 | | | | |
| 8 | Carriage rotation counter-clockwise | Position C (Outboard supply, Inboard return) | Position E (Return) | Position G (Supply) |

At the conclusion of step 8, the cycle is completed and step 1 is initiated to repeat the next cycle.

The solids feeder of this invention employing stationary hydraulic rams offers several benefits. Ram 42 located below the solids feed chute can be of smaller size than ram 40 located below the solids upflow vessel, whereas with the embodiment of feeder wherein the rams are alternately positioned below the solids upflow vessel, all of the rams must be sized for this heavy duty service even though they may be substantially oversized during the cylinder filling cycle. Also, the smaller ram employed in this invention requires a substantially reduced volume of high and low pressure hydraulic fluid than the larger sized ram.

While the solids feeder of this invention has been described in connection with a solids upflow oil shale retort adapted for the feed of particulated solid oil shale having sizes in the range of about ⅛ to 2 inches, it is to be recognized that the device is not so limited and has utility in the transport of free-flowing particulated solids of any type from an elevated feed bin into the bottom of an upflow solids vessel.

Various embodiments and modifications of this invention have been described in the foregoing description, and further modifications will be apparent to those skilled in the art. Such modifications are included within the scope of this invention as defined by the following claims.

Having now described the invention, we claim:

1. A solids feeder for introducing particulated solids into a solids upflow vessel having a bottom solids inlet opening, which comprises:

a carriage adapted for rotation about a central vertical axis;

a solids feed chute communicating with an elevated solids feed reservoir for transporting particulated solids from said solids feed reservoir by gravity flow, said solids feed chute terminating in a bottom outlet opening located in the same horizontal plane as the bottom solids inlet opening of said solids upflow vessel, said solids inlet opening of said solids upflow vessel and the bottom outlet opening of said feed chute being equally spaced from the central vertical axis of said rotatable carriage along a horizontal axis intersecting the axis of rotation of said carriage;

carriage support means for rotatably supporting said carriage in a horizontal position below said solids upflow vessel and said solids feed chute;

first and second vertical solids feed cylinders mounted on said carriage in spaced relationship, said cylinders being equally spaced from the central axis of said rotatable carriage along a diameter therof, said first solids feed cylinder being axially aligned with and immediately below the bottom solids inlet opening of said solids upflow vessel and said second cylinder being axially aligned with and immediately below the bottom outlet opening of said solids feed chute when said carriage is in a first stationary position, and said first solids feed cylinder being axially aligned with and immediately below the bottom outlet opening of said solids feed chute and the second solids feed cylinder being axially aligned with and immediately below the bottom solids inlet opening of said solids upflow vessel when said carriage is in a second stationary position;

carriage drive means for rotating said carriage between said first and second stationary positions;

a first free-floating solids feed piston movably mounted in said first solids feed cylinder;

a second free-floating solids feed piston movably mounted in said second solids feed cylinder;

a first hydraulic ram vertically mounted below said bottom solids inlet opening of said solids upflow vessel to alternately move said first and second pistons in their respective cylinders upwardly to displace particulated solids from said cylinders upwardly into said solids upflow vessel;

a second hydraulic ram vertically mounted below said outlet opening of said feed chute to alternately control the movement of said first and second piston in their respective cylinders to fill said cylinders with particulated solids from said solids feed chute;

piston support means for supporting said first and second free-floating pistons at the bottom of a filled solids feed cylinder and at the top of an empty solids feed cylinder;

solids sealing means for sealing said bottom outlet opening of said solids feed chute and the solids inlet opening of said solids upflow vessel when said first and second solids feed cylinders are not axially aligned therewith; and control means for synchronizing the rotation of said carriage and the movement of said first and said second solids feed pistons.

2. The apparatus defined in claim 1 wherein said bottom solids inlet opening of said solids upflow vessel, said bottom outlet opening of said feed chute and said rotatable carriage are encased in a fluid-tight housing.

3. The apparatus defined in claim 1 wherein said solids sealing means comprises a horizontal planar surface at the top of said carriage which is maintained in close proximity to the bottom outlet opening of said solids feed chute and the bottom solids inlet opening of said solids upflow vessel when said first and second solids feed cylinders are not aligned therewith.

4. The apparatus defined in claim 1 wherein said piston support means includes an internally disposed lip at the bottom of each of said first and second solids feed cylinders to support said pistons at the bottom of a filled cylinder, and a plurality of hydraulically extendable dogs located about the periphery of said cylinders near the top thereof to support said pistons at the top of an empty cylinder.

5. The apparatus defined in claim 1 wherein said control means includes (1) rate control means for controlling the speed of movement of said carriage and said first and second hydraulic ras; and (2) motion sequence control means to effect the movement of said carriage between first and said second stationary positions while maintaining said first and second hydraulic rams stationary in a retracted position, and to simultaneously extend and retract said first and second hydraulic rams and to extend and retract said hydraulically extendable dogs during a selected portion of the sequence while maintaining said carriage in said first or said second stationary positions.

6. A solids feeder for transporting particulated solids from an elevated solids feed reservoir and introducing said solids into a solids upflow vessel having a bottom solids inlet opening, which comprises:

a carriage adapted for rotation about a central vertical axis;

a solids feed chute communicating with an elevated solids feed reservoir for transporting particulated solids from said solids feed reservoir by gravity flow, said solids feed chute terminating in a bottom outlet opening located in the same horizontal plane as the bottom as the bottom solids inlet opening of said solids upflow vessel, said solids inlet opening of said solids upflow vessel and the bottom outlet opening of said feed chute being of approximately the same diameter and being equally spaced from the central vertical axis of said rotatable carriage along a horizontal axis intersecting the axis of rotation of said carriage;

carriage support means for rotatably supporting said carriage in a horizontal position below said solids upflow vessel and said solids feed chute;

first and second solids feed cylinders vertically mounted on said rotatable carriage in spaced relationship, said cylinders being of approximately the same diameter as said bottom solids inlet opening of said solids upflow vessel and said bottom outlet opening of said solids feed chute and said cylinders being spaced from the central axis of said rotatable carriage along a diameter thereof a distance equal to the spacing of said bottom inlet opening of said solids upflow vessel and said bottom outlet opening of said solids feed chute so that said first solids feed cylinder is axially aligned with and immediately below the bottom solids inlet opening of said solids upflow vessel and said second solids feed cylinder is axially aligned with and immediately below the bottom outlet opening of said solids feed chute when said carriage is in a first stationary position, and said first solids feed cylinder is axially aligned with and immediately below the bottom outlet opening of said solids feed chute and said second solids feed cylinder is axially aligned with and immediately below the bottom solids inlet opening of said solids upflow vessel when said carriage is in a second stationary position;

carriage drive means for rotating said carriage between said first and said second stationary positions;

a first free-floating solids feed piston movably mounted in said first solids feed cylinder;

a second free-floating solids feed piston movably mounted in said second solids feed cylinder;

bottom piston support means located at the bottom of each of said first and second solids feed cylinders to support the piston at the bottom of a filled cylinder;

upper piston support means located near the top of each of said first and second solids feed cylinders to support the piston at the top of an empty cylinder;

a first hydraulic ram vertically mounted below said bottom solids inlet opening of said solids upflow vessel to alternately move said first or second pistons in their respective cylinders upwardly to displace particulated solids from said cylinders upwardly into said solids upflow vessel;

a second hydraulic ram vertically mounted below said outlet opening of said feed chute to alternately control the movement of said first or second piston in its respective cylinder to fill said cylinder with particulated solids from said solids feed chute;

solids sealing means for sealing the bottom outlet opening of said solids feed chute and the bottom solids inlet opening of said solids upflow vessel when said first and second solids feed cylinders are not axially aligned therewith; and control means for controlling the speed of movement of said carriage and said first and second hydraulic rams, for effecting the rotation of said carriage between said first and second stationary positions while maintaining said first and second hydraulic rams stationary in a retracted position, and for simultaneously extending and retracting said first and second hydraulic rams and to actuate said upper piston support means during a selected portion of the sequence while maintaining said carriage in said first or second stationary positions.

7. The apparatus defined in claim 6 wherein said bottom solids inlet opening of said solids upflow vessel, said bottom outlet opening of said feed chute and said rotatable carriage are encased in a fluid-tight housing.

8. The apparatus defined in claim 6 wherein said solids sealing means comprises a horizontal planar surface at the top of said carriage which is maintained in close proximity to the bottom outlet opening of said solids feed chute and the bottom solids inlet opening of said solids upflow vessel when said first and second solids feed cylinders are not aligned therewith.

9. The apparatus defined in claim 6 wherein said bottom piston support means comprises an internally disposed lip at the bottom of each of said first and second solids feed cylinders to support said pistons at the bottom of a filled cylinder.

10. The apparatus defined in claim 6 wherein said upper piston support means comprises s plurality of hydraulically extendable dogs located about the periphery of said cylinders near the top thereof to support said pistons at the top of an empty cylinder.

11. A solids feeder for transporting particulated solids from an elevated solids feed reservoir and introducing said solids into a solids upflow retort vessel having a bottom solids inlet opening, which comprises:

a carriage adapted for rotation about a central vertical axis;

a solids feed chute communicating with an elevated solids feed reservoir for transporting particulated solids from said solids feed reservoir by gravity flow, said solids feed chute terminating in a bottom outlet opening located in the same horizontal plane as the bottom solids inlet opening of said solids upflow retort vessel, said solids inlet opening of said solids upflow vessel and the bottom outlet opening of said feed chute being of approximately the same diameter and being equally spaced from the central vertical axis of said rotatable carriage along a horizontal axis intersecting the axis of rotation of said carriage;

a fluid-tight housing encasing the bottom of said retort vessel, the bottom of said solids feed chute, and said carriage;

carriage support means for rotatable supporting said carriage in a horizontal position within said fluid-tight housing below said solids upflow retort vessel and said solids feed chute;

first and second solids feed cylinders vertically mounted on said rtoatable carriage in spaced relationship, said cylinders being of approximately the same diameter as said bottom solids inlet opening of said solids upflow retort vessel and said bottom outlet opening of said solids solids feed chute and said cylinders being spaced from the central axis of said rotatable carriage along a diameter thereof a distance equal to the spacing of said bottom inlet opening of said solids upflow retort vessel and said bottom outlet opening of said solids feed chute so that said first solids feed cylinder is axially aligned with and immediately below the bottom solids inlet opening of said solids upflow retort vessel and said second solids feed cylinder is axially aligned with and immediately below the bottom outlet opening of said feed chute when said carriage is in a first stationary position, and said first solids feed cylinder is axially aligned with and immediately below the bottom outlet opening of said solids feed chute and said second solids feed cylinder is axially aligned with and immediately below the bottom solids inlet opening of said solids upflow retort vessel when said carriage is in a second stationary position displaced 180 degrees from said first position;

carriage drive means for rotating said carriage 180° between said first and second stationary positions;

a first free-floating solids feed piston movably mounted in said first solids feed cylinder;

a second free-floating solids feed piston movably mounted in said second solids feed cylinder;

an internally disposed lip at the bottom of each of said first and second solids feed cylinders to support said pistons at the bottom of a filled cylinder;

a plurality of hydraulically extendable dogs located about the periphery of said cylinders near the top thereof to support said pistons at the top of an empty cylinder;

a second hydraulic ram vertically mounted below said outlet opening of said feed chute and extending into said housing to alternately control the movement of said first or second piston in its respective cylinder to fill said cylinder with particulated solids from said solids feed chute;

a horizontal planar surface at the top of said carriage which is maintained in close proximity to the bottom outlet opening of said solids feed chute and the bottom solids inlet opening of said solids upflow retort vessel when said first and second solids feed cylinders are not aligned therewith; and control means for controlling the speed of movement of said carriage and said first and second hydraulic rams, for effecting the rotation of said carriage between said first and said second stationary positions while maintaining said first and second hydraulic rams stationary in a retracted position out of contacting with said carriage, and for simultaneously extending and retracting said first and second hydraulic rams and to extend and retract said hydraulically extendable dogs during a selected portion of the sequence while maintaining said carriage in said first or second stationary positions.

12. A method for transporting particulated solids from an elevated solids feed reservoir and introducing said solids into a solids upflow vessel having a bottom solids inlet opening, which comprises:

transporting said particulated solids by gravity flow from said solids feed reservoir to a first station located adjacent to the bottom solids inlet opening of said solids upflow vessel;

positioning a first solids feed cylinder fitted with a first free-floating piston and filled with particulated solids directly below said solids inlet opening of said solids upflow vessel and a second solids feed cylinder fitted with a second free-floating piston directly below said first station;

simultaneously moving said first free-floating piston upwardly to displace the solids from said first cylinder upwardly into said solids upflow vessel and moving said second free-floating piston downwardly to fill said second cylinder by gravity flow with particulated solids;

maintaining said first piston at the top of said first cylinder and said second piston at the bottom of said second cylinder while moving each of said cylinders along an arcuate path of 180° so that said first cylinder is positioned directly below said first station and said second cylinder is positioned directly below said solids inlet opening of said solids upflow vessel; and simultaneously moving said second free-floating piston upwardly to displace the solids from said second cylinder upwardly into said solids upflow vessel and moving said first free-floating piston downwardly to fill said first cylinder by gravity flow with particulated solids.

13. The method defined in claim 12 wherein said steps are repeated for a plurality of cycles.

14. The method defined in claim 12 wherein said cylinders are moved along said arcuate paths in the same directions.

15. The method defined in claim 12 wherein said cylinders are moved along said acuate paths in the opposite directions in each successive step of moving said cylinders.

* * * * *

UNITED STATES PATENT AND TRADEMARK OFFICE

CERTIFICATE OF CORRECTION

PATENT NO. : 4,033,467

DATED : July 5, 1977

INVENTOR(S) : William L. Bewley et al.

It is certified that error appears in the above-identified patent and that said Letters Patent are hereby corrected as shown below:

In Col. 13, line 9, claim 5, "ras" should read --rams--;
Col. 13, line 30, claim 6, "as the bottom" first occurrence should be deleted;
Col. 14, line 56, claim 10, "s" should be an --a--;
Col. 15, line 14, claim 11, "rotatable" should read --rotatably--;
Col. 15, line 19, claim 11, "rtoatable" should read --rotatable--;
Col. 15, line 23, claim 11, "solids" first occurrence should be deleted; and
Col. 16, line 59, claim 15, "acuate" should read --arcuate--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*